United States Patent [19]

Sterling

[11] 4,257,584

[45] Mar. 24, 1981

[54] COMBINATION CLAMPING AND SPREADING TOOL

[76] Inventor: Larry P. Sterling, 1185 Genie Ct., SE., Salem, Oreg. 97302

[21] Appl. No.: 82,712

[22] Filed: Oct. 9, 1979

[51] Int. Cl.[3] ..... B25B 1/10

[52] U.S. Cl. ..... 269/88; 269/167; 269/252

[58] Field of Search ..... 269/88, 167-170, 269/244, 246, 252; 29/256

[56] References Cited

U.S. PATENT DOCUMENTS

| | | | |
|---|---|---|---|
| 2,221,325 | 11/1940 | Holman | 269/167 |
| 2,815,053 | 12/1957 | Walker | 269/252 X |
| 3,061,302 | 10/1962 | Dennis | 269/88 X |

*Primary Examiner*—Robert C. Watson

*Attorney, Agent, or Firm*—James D. Givnan, Jr.

[57] ABSTRACT

A tool capable of applying clamping forces or, alternatively, spreading forces to the surfaces of spaced apart articles. The tool includes an elongate tubular base at one end of which is removably mounted a tail stop which serves to impart both clamping and spreading forces to associated articles. Mounted at the opposite end of the tubular base is a boss which is internally threaded to receive the screw shaft of a traveler assembly. The traveler assembly includes oppositely disposed, force imparting members which coact with the tail stop in clamping and spreading operations. Movement is imparted to the traveler assembly by a ratchet wrench on the screw shaft. The traveler assembly may be additionally supported by a telescopic member in slidable engagement with the tubular base of the tool.

5 Claims, 2 Drawing Figures

COMBINATION CLAMPING AND SPREADING TOOL

BACKGROUND OF THE INVENTION

The present invention relates generally to hand tools and particularly to a clamping and spreading tool for a wide variety of uses in machine shops, cabinet works, etc.,.

In wide use today are various clamping tools which generically include an elongate support member having a positionable and lockable tail stop at one end which cooperates with a remaining screw shaft mounted clamping member at the other end of the elongate support member. The first mentioned stop is referred to in the trade as a tail stop and is manually positionable on the support member, usually a tube, prior to screw shaft advancement of the remaining clamping member.

No provision is made in such tools for exerting spreading forces or action on two related or unrelated objects. Within the term "spreading", as presently used, is the operation of imparting a lifting force to an object.

Known clamping tools are limited to use in a clamping operation as the load contacting (clamping) members are not adapted for imparting force in an opposite direction nor is the actuating member disposed so as to be manually operable when located imtermediate the articles being spread apart.

SUMMARY OF THE PRESENT INVENTION

The present invention is embodied within a hand tool for imparting both clamping and spreading forces over a wide range of distances.

The present tool includes a tubular base member not unlike that used in known clamping tools. Similarly a tail stop is utilized on said tubular member which stop may be of the same type currently found on clamping tools. A boss at one end of the tubular member is internally threaded to receive a screw shaft which is part of a traveler assembly which also includes multiple biasing members oppositely located at the screw shaft ends. The traveler assembly may include a stabilizer rod in supported relationship with the tubular base member. A screw shaft actuator, shown as a box end ratchet wrench, enables shaft rotation even in restricted clearance situations.

Important objectives of the present invention include the provision of a single tool for both clamping and spreading functions; the provision of a tool having a wide range of uses within a machine shop, cabinet works, etc., and yet of comparable simplicity for low cost production; the provision of a tool utilizing low cost, standard pipe as a base enabling the adaptation of the tool to a wide range of spreading or clamping tasks, and; the provision of a tool capable of imparting extraordinary forces to objects without risk of tool failure. These and other objects will become subsequently apparent upon an understanding of the invention.

DETAILED DESCRIPTION OF THE PREFERRED EMBODIMENT

Figure 1:
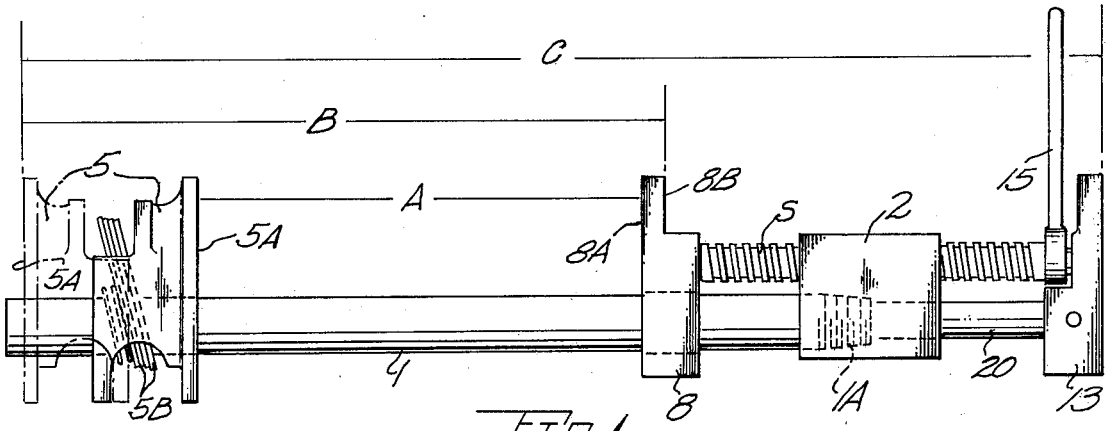
FIG. 1 is a side elevational view of the tool.

With continuing reference to the drawing, the reference numeral 1 indicates a base which is of tubular construction and, for reasons of convenience, may be of any length of standard metal pipe to suit the task at hand.

Indicated at 2 is a boss internally threaded at 3 to receive the threaded end 1A of tubular base 1. A bore at 4 in the boss receives a later described extension. A tail stop at 5 may be of conventional design such as that used with existing clamping tools and is removable and reversible per the broken line position. An acceptable tail stop has a load surface 5A. Spring urged plates at 5B are automatically urged into binding contact with the base.

Figure 2:
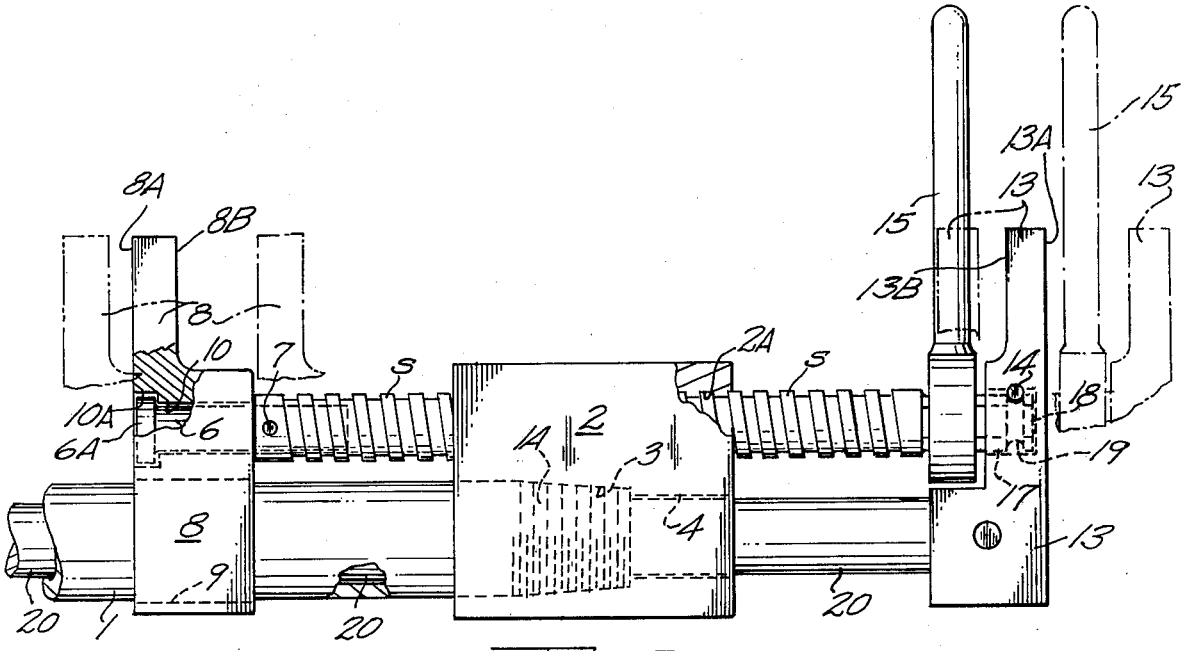
FIG. 2 is an enlarged view of the right hand end of the tool of FIG. 1 with parts broken away for illustrative purposes.

A traveler assembly includes a screw shaft S in threaded engagement at 2A with the boss. Carried at the inner end of screw shaft S is a pin 6 secured to the screw shaft by a cross pin 7 extending through the bored end of the screw shaft. A first biasing member at 8 defines a bore 10 and a counterbore 10A within which is received a head 6A of pin 6. Accordingly, screw shaft advancement causes screw shaft S to urge biasing member 8 to the left or double dot broken line position (FIG. 2) to provide a clamping bite at A while opposite screw shaft movement retracts biasing member 8 to the right or single dot broken line position in a spreading operation over a typical distance indicated at B. Member 8 is bored at 9 to slidably receive tubular member 1. Member 8 has a clamping surface at 8A and a spreading surface at 8B.

The traveler assembly additionally includes a second biasing member at 13 at the remaining end of screw shaft S. A roll pin at 14 extends through member 13 and tangentially past a hexagonal end segment 17 of shaft S which end is grooved at 19 for pin reception. Accordingly, the screw shaft is coupled to said second biasing member in a rotatable manner. A screw shaft end 18 imparts outward force to said second biasing member.

Means for imparting rotation to the screw shaft and hence axial movement of same is embodied in a box end ratchet wrench 15 of substantially conventional design in place on the hexagonal end 17 of the shaft. Spreading forces over a typical spreading distance at C are imparted to an article by the outer spreading surface 13A of the second biasing member. An oppositely directed reaction spreading force is imparted by tail stop surface 5A which has been re-orientated on base 1 per the broken line position of FIG. 1.

An extension at 20 is provided on the second biasing member which extension is in sliding telescopic engagement with base 1 and serves to support biasing member 13 against loads encountered in a spreading operation.

In operation it will be understood that actuating wrench 15 may move through a wide arc to facilitate rapid positioning of the traveler assembly. Conversely, if the conditions encountered limit wrench movement the same may be reciprocated through a small arc without seriously detracting from the tool's usefulness. Other wrenching means could be utilized with somewhat less convenience. Further, biasing members 8 and 13 are subjected to changes in configuration to suit any predominate task at hand. For example, biasing member 13 may be of greater vertical dimension than biasing member 8 to permit a clamping operation to be effected intermediate the inner surface 13B of said member and surface 5A of the tail stop modified to be of a corresponding vertical dimension.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A tool for alternatively exerting clamping forces or spreading forces on spaced apart article surfaces, said tool comprising, a base of elongate shape having a tail stop thereon, a boss on one end of said base and defining an internally threaded bore, and a traveler assembly including a screw shaft engaged with said threaded bore of the boss, means for imparting rotation and hence axial movement to said screw shaft, a first biasing member at one end of said screw shaft, a second biasing member at the remaining end of said screw shaft, said biasing members adapted for joint movement relative said boss upon screw shaft rotation whereby a biasing member may in conjunction with said tail stop exert forces on abutting surfaces.

2. The tool claimed in claim 1 wherein said second biasing member includes an extension slidably engageable with said base.

3. The tool claimed in claim 2 wherein said rotation imparting means is a ratchet wrench.

4. The tool claimed in claim 1 wherein said tail stop is detachable and reversibly mountable on said base.

5. The tool claimed in claim 4 wherein at least one of said biasing members has oppositely directed surfaces for alternatively imparting clamping or spreading forces to an abutting surface.

* * * * *